US010858932B2

(12) United States Patent
Hudson

(10) Patent No.: US 10,858,932 B2
(45) Date of Patent: Dec. 8, 2020

(54) MONITORING WELL INSTALLATIONS

(71) Applicant: METROL TECHNOLOGY LTD, Aberdeen (GB)

(72) Inventor: Steven Martin Hudson, Aberdeen (GB)

(73) Assignee: METROL TECHNOLOGY LTD, Aberdeenshire (GB)

( * ) Notice: Subject to any disclaimer, the term of this patent is extended or adjusted under 35 U.S.C. 154(b) by 0 days.

(21) Appl. No.: 16/498,422

(22) PCT Filed: Mar. 31, 2017

(86) PCT No.: PCT/GB2017/050911

§ 371 (c)(1),
(2) Date: Sep. 27, 2019

(87) PCT Pub. No.: WO2018/178606

PCT Pub. Date: Oct. 4, 2018

(65) Prior Publication Data

US 2020/0318475 A1 Oct. 8, 2020

(51) Int. Cl.
*G01V 3/00* (2006.01)
*E21B 47/13* (2012.01)
(Continued)

(52) U.S. Cl.
CPC ..... *E21B 47/13* (2020.05); *E21B 33/134* (2013.01); *E21B 47/125* (2020.05)

(58) Field of Classification Search
CPC ..... E21B 47/13; E21B 47/125; E21B 33/134
(Continued)

(56) References Cited

U.S. PATENT DOCUMENTS 5,394,141 A * 2/1995 Soulier ..... H04B 13/00 340/854.4
6,478,086 B1 * 11/2002 Hansen ..... E21B 33/02 166/250.17
(Continued)

FOREIGN PATENT DOCUMENTS

EP 0 314 654 5/1989
EP 0314654 A1 * 5/1989 ..... E21B 47/13
(Continued)

OTHER PUBLICATIONS

International Search Report for PCT/GB2017/050911, dated Dec. 22, 2017, 5 pages.
(Continued)

*Primary Examiner* — Tanmay K Shah
(74) *Attorney, Agent, or Firm* — Nixon & Vanderhye, P.C.

(57) ABSTRACT

A monitoring well installation comprising metallic casing (2) and a sealing material plug (6) provided downhole in the borehole for sealing the borehole against the egress of fluid from a zone below the plug. There is an uncased length of borehole at least 10 m in length in which the plug seals against the formation. There is provided a downhole sensing tool (3) located below the plug (6) and a communication arrangement (31, 5, 4) for use in transmitting data from the sensing tool towards the surface, which comprises an across plug communication apparatus (5) comprising a pair of spaced contacts (51) contacting the casing and/or the formation and a transmitter located below the plug (6) for transmitting signals carrying data across the plug towards the surface.

15 Claims, 4 Drawing Sheets

Figure 1:
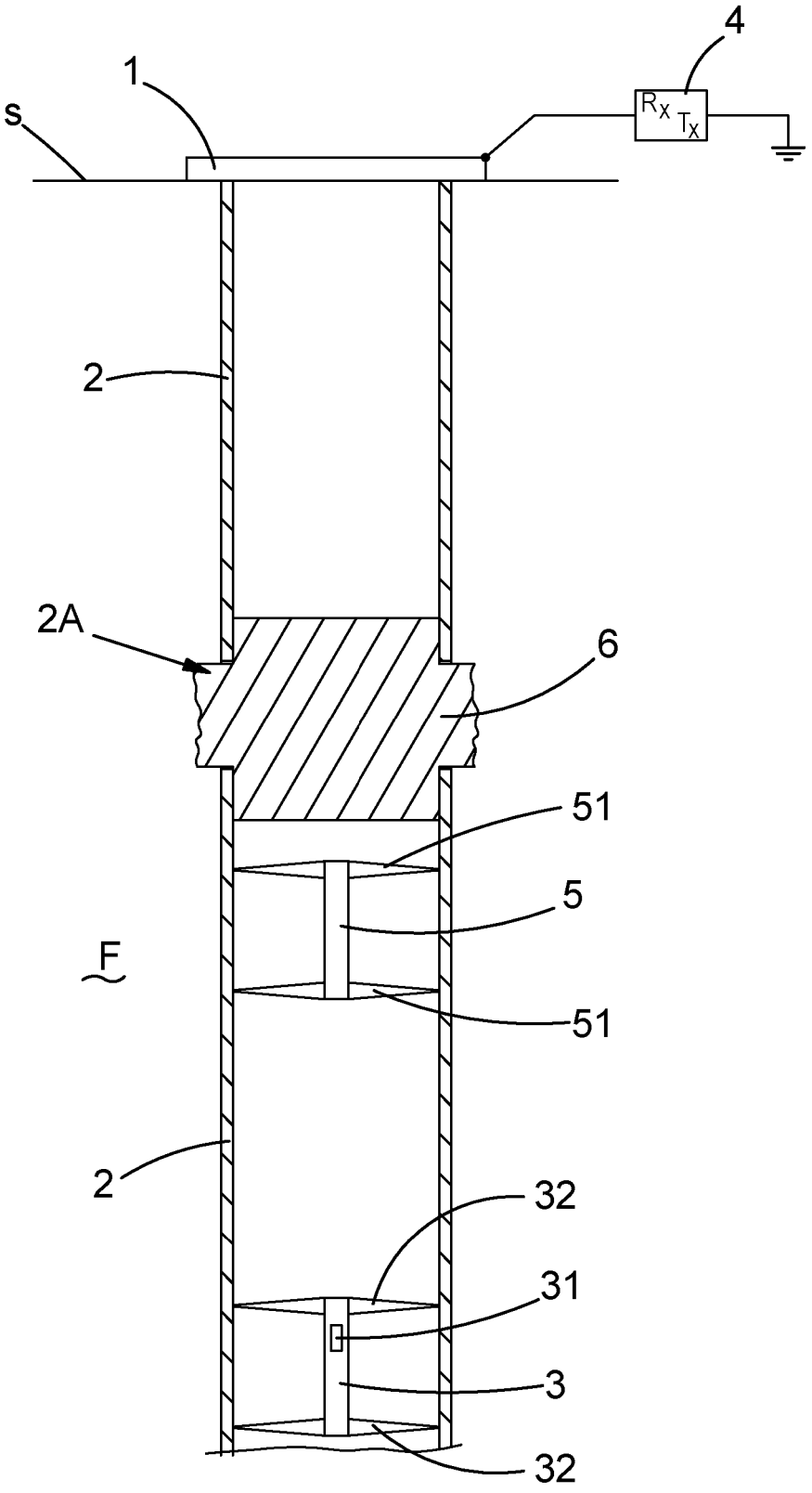

(51) Int. Cl.
*E21B 33/134* (2006.01)
*E21B 47/125* (2012.01)

(58) Field of Classification Search
USPC ..... 340/854.6
See application file for complete search history.

(56) References Cited

U.S. PATENT DOCUMENTS

| | | | | |
|---|---|---|---|---|
| 2014/0020953 | A1* | 1/2014 | Chau | G01V 3/18 175/25 |
| 2017/0081956 | A1* | 3/2017 | Ganguly | E21B 47/13 |
| 2018/0010448 | A1* | 1/2018 | Hay | E21B 17/003 |

FOREIGN PATENT DOCUMENTS

| | | |
|---|---|---|
| EP | 1 076 759 | 2/2001 |
| NO | 20151746 | 10/2016 |
| WO | 2017/105251 | 6/2017 |

OTHER PUBLICATIONS

Written Opinion of the ISA for PCT/GB2017/050911, dated Dec. 22, 2017, 6 pages.

* cited by examiner

MONITORING WELL INSTALLATIONS

This application is the U.S. national phase of International Application No. PCT/GB2017/050911 filed 31 Mar. 2017, which designated the U.S., the entire contents of which is hereby incorporated by reference.

This invention relates to monitoring well installations. In particular it relates to monitoring well installations which may be installed in an oil and/or gas field to allow monitoring of a parameter within that oil and/or gas field for a prolonged period of time.

There is a general desire to be able to monitor parameters in an oil and/or gas reservoir over time. This might be whilst the oil and/or gas field is active and at least some wells in the field are producing product (oil and/or gas) or it may be before a field becomes active and evaluation is taking place or whilst a field is inactive after a period of production.

In all such circumstances it is important that monitoring can take place with a minimum of risk, in particular a minimum of risk of product escaping from the reservoir towards the surface.

Thus in different circumstances various different sealing devices are used for sealing well installations which have been drilled into an oil field. Cement plugs are often used for long term sealing of the boreholes of wells. The cement based material of the plug is used as a sealing material. Typically the borehole will be lined with metallic casing. Thus when a cement plug is provided in the borehole for sealing a well against the escape of oil and/or gas, sealing between the cement plug and the internal surface of the metallic casing is important. One particular way oil and/or gas may escape is by the formation of escape paths for fluid at the annular interface between the cement plug and the surrounding metallic casing. Another way in which oil and/or gas may escape is through the micro-annulus between the outside diameter of the casing and the cement seal to the inside diameter of the borehole/formation. This outer cement seal is made during well construction by pumping cement into the gap between casing and borehole wall and frequently does not provide a good seal.

At the same time, having one or more cement plug in a borehole for sealing the well can present challenges for extracting data from locations below the cement plug. This is at least partly because putting any form of cable or other component through a cement plug causes another potential leak path past the plug and thus in general terms this has to be avoided.

In the present specification, the expression "surface" encompasses the land surface of a land well where a wellhead would be located, the sea bed/mudline in a subsea well and a wellhead deck on a platform. It also encompasses locations above these locations where appropriate. Generally "surface" is used to refer to any convenient location for applying and/or picking up signals, for example, which is outside the borehole of the well.

In the present specification the expressions "lower", "deeper", "below" etc in the borehole/well mean further into the well away from the well head. Even in a horizontal portion of a borehole it will thus be clear when a location or component is "deeper" or "lower" etc than another as meant in the present specification. Corresponding considerations apply to expressions such as "upper", "shallower", "above" etc.

It would be desirable to provide methods and installations for allowing the monitoring of downhole parameters whilst taking the above issues into account.

According to one aspect of the present invention there is provided a monitoring well installation comprising metallic casing running down from the surface into a borehole and a sealing material plug provided downhole in the borehole for blocking the interior of the casing and sealing the borehole against the egress of fluid from a zone below the plug, wherein there is an axial spacing between adjacent casing portions in the region of the plug such that there is an uncased length of borehole in which the material of the plug seals against the formation in which the borehole is drilled, and wherein there is provided a downhole sensing tool located below the plug for sensing at least one parameter below the plug and a communication arrangement for use in transmitting data from the sensing tool towards the surface, wherein the communication arrangement comprises across plug communication apparatus located below the plug for transmitting signals carrying data across the plug towards the surface and the across plug communication apparatus comprises a pair of spaced contacts, a first of which contacts with the casing below the plug at first location and the second of which contacts with the casing at a second location further into the borehole than the first location or contacts with the formation at a second location further into the borehole than the first location and a transmitter or transceiver for applying signals via the spaced contacts to generate a voltage dipole in the casing to cause electric field in the formation in the region of the plug such as to result in current flow, in use, in the casing portion above the axial spacing, the axial spacing being at least 10 m in length.

Such an arrangement can provide monitoring of an oil and/or gas reservoir whilst minimising the risk of escape of fluids via the monitoring well. It will be appreciated that communication across the plug is thus achieved using EM (electromagnetic) signalling and that this, at least primarily, occurs through the formation in the region of the plug.

The axial spacing may have different lengths in different circumstances. For example the axial spacing may be in the range of 10 m to 100 m.

The transmitter or transceiver may be arranged for applying signals via the spaced contacts having a frequency in the range of 0.1 Hz to 1 kHz.

There will be an optimum frequency for the signals in terms of signalling effectiveness across the plug which depends on the length of the axial spacing. The frequency of signals which the transmitter or transceiver is arranged to apply may be selected in dependence on the length of the axial spacing. Typically a larger axial spacing calls for a lower frequency.

There will be an optimum frequency for the signals in terms of signalling effectiveness across the plug which depends on the conductivity of the formation in the region of the plug. The frequency of signals which the transmitter or transceiver is arranged to apply may be selected in dependence on the conductivity of the formation in the region of the plug.

There will be an optimum spacing between the second location and the lower end of the axial spacing in terms of signalling effectiveness across the plug which depends on the length of the axial spacing. The spacing between the second location and the lower end of the axial spacing may be selected in dependence on the length of the axial spacing.

Typically the sealing material plug will be a cement plug of cement based material. But other materials may be used that can be introduced in a form to conform to the space that needs to be filled and then seal to the surroundings. Typically the sealing material will be introduced in a liquid form and set. Typically this will be a chemical setting process. The sealing material may be a solidified material. The sealing material will typically be an insulating material. The sealing material may have a resistivity which is at least ten times that of the metal of the metallic casing.

It will be appreciated that where there are a plurality of runs of casing at the location where the axial spacing, or gap, is formed, an axial spacing will be provided in each run of casing so that the sealing material can seal to the formation. The gap in each run of casing may have the same length and the gaps may all be in register with one another.

In one set of embodiments, the communication arrangement comprises a below plug communication unit provided in or communicatively connected to the sensing tool for transmitting signals carrying data towards the surface and the across plug communication apparatus comprises the below plug communication unit.

In another set of embodiments, the communication arrangement comprises a below plug communication unit provided in or communicatively connected to the sensing tool for transmitting signals carrying data towards the surface and a below plug repeater communication unit for receiving signals from the below plug communication unit and transmitting signals onwards towards the surface, wherein the across plug communication apparatus comprises the below plug repeater communication unit.

The communication arrangement may comprise at least one auxiliary repeater communication unit in the communication channel from the downhole sensing tool towards the surface for assisting in communication of data towards the surface. The at least one auxiliary repeater communication unit may be located above or below the plug. There may be at least two auxiliary repeater communication units with at least one located below the plug and at least one located above the plug.

The at least one auxiliary repeater communication unit may be provided in addition to the below plug repeater communication unit. The at least one auxiliary repeater communication unit may be provided when there is no below plug repeater communication unit of the type defined above.

The at least one auxiliary repeater communication unit may comprise an above plug repeater communication unit located above the plug for picking up signals from the casing portion above the axial spacing due to said current flow.

The above plug repeater communication unit may comprise a pair of spaced contacts for picking up the signals, a first of which contacts with the casing above the plug at third location and the second of which contacts with the casing at fourth location further towards the surface than the third location.

The communication arrangement may comprise a plurality of repeater communication units which are all arranged in a chain for communicating one to another. Thus there may be a plurality of auxiliary repeater communication units, or one auxiliary repeater communication unit and the below plug repeater communication unit, or a plurality of auxiliary repeater communication units and the below plug repeater communication unit.

Note that a repeater communication unit may receive signals directly or indirectly from the below plug communication unit. Further any one repeater communication unit may operate in one of a number of different ways provided it performs the function of assisting in transmission of the desired data between the appropriate locations—it may for example be implemented as a pure amplifier picking up, amplifying and reapplying the signals, or it may receive signals perform some processing beyond mere amplification and re-transmit them, accordingly the signals may be re-transmitted in the same or a different form than received (eg different modulation scheme, different carrier signal or different signalling technique/transmission medium altogether), in some cases the data to be transmitted may be extracted from the received signal at the repeater communication unit and used to generate a new signal encoding appropriate data, and so on.

The system may be arranged for signalling in both directions. As such: the below plug communication unit may be arranged for receiving signals; and the or each repeater communication unit may be arranged for transmitting signals onwards towards the below plug communication unit in response to signals received from elsewhere.

There will be an optimum location for picking up signals using the above plug repeater communication unit which will depend on the profile of the current induced in the casing portion above the axial spacing.

The spacing between the fourth location and the upper end of the axial spacing may be selected in dependence on the expected profile of the current induced in the casing portion above the axial spacing.

The above plug repeater communication unit may be arranged for sending signals downwards past the plug. In such a case the above plug repeater communication unit can operate in the same way as the across plug communication apparatus located below the plug.

There will be an optimum spacing between the fourth location and the upper end of the axial spacing in terms of signalling effectiveness across the plug which depends on the length of the axial spacing. The spacing between the fourth location and the upper end of the axial spacing may be selected in dependence on the length of the axial spacing.

The spacing between the fourth location and the upper end of the axial spacing may be selected in dependence on the length of the axial spacing and in dependence on the expected profile of the current induced in the casing portion above the axial spacing. A compromise position may be selected.

In an alternative two above plug repeater communication units can be provided, one positioned for picking up signals from across the plug and one for sending signals across the plug.

If desired the expected profile of the current induced in the casing portion below the axial spacing due to the operation of the above plug repeater communication unit may be taken into account when selecting the spacing between the second location and the lower end of the axial spacing. Similarly again two apparatus might be provided below the plug—one to pick up signals and one to apply signals.

Note that in each case above the selected spacings between the second location and the lower end of the axial spacing and between the fourth location and the upper end of the axial spacing can be made directly or indirectly. That is, the actual spacing mentioned can be directly selected or indirectly selected by virtue of another reference spacing being first selected—eg between a midpoint of say the below plug repeater and a midpoint of the axial spacing or so on, and the spacing mentioned being thereby determined and hence indirectly selected.

There will be an optimal or desirable distance for the spacing between the spaced contacts of the below plug communication unit and/or the or each repeater communication unit. This may be determined based on desired or practical size for the component and/or determined based on an optimal performance for applying and/or picking up signals. A typically spacing between the spaced contacts might be 10 m.

The communication arrangement may be arranged to use one or more of a plurality of signalling techniques, for example one or more of:

EM signals;
Acoustic signals;
Inductive signals;
Radio Frequency signals;
Impedance modulation signals;
Optical signals;
Pressure pulse signals;
Hydraulic control line signals; and
Cable carried electrical signals.

Different signalling techniques may be chosen for different respective parts of the signal channel between the below plug communication unit and the surface. Thus one or more repeater communication unit may be arranged to pick up (and optionally apply) one type of signals from a first part of the signal channel and may be arranged to apply (and optionally pick up) another type of signals to a second part of the signal channel.

In some cases two or more signalling techniques may be used in parallel. This can give redundancy to improve robustness.

The below plug communication unit or the below plug repeater communication unit may have a first contact which contacts with the casing and a second contact which contacts with the formation at an open hole location. This, for example, may be the case when the below plug communication unit or the below plug repeater communication unit comprises the across plug communication apparatus.

The below plug communication unit or the below plug repeater communication unit may be arranged to apply (and optionally pick up) signals via an elongate metallic member that extends from a cased region to an open hole region. The below plug communication unit or the below plug repeater unit may apply signals to (and optionally pick up signals from) the elongate metallic member via an inductive coupling provided around the metallic elongate member or across an insulation joint in the elongate member.

The well installation may comprise at least one auxiliary sealing material plug disposed at a different depth within the borehole for blocking the interior of the casing and sealing the borehole against the egress of fluid from a zone below the respective auxiliary plug. There may or may not be a corresponding axial spacing between adjacent casing portions in the region of each auxiliary plug. Thus there might be only one such axial spacing, the auxiliary plugs being disposed at fully cased locations.

Where there is at least one auxiliary plug, the communication arrangement can be arranged for signalling past the auxiliary plug. Typically signals may progress in the casing past the location of an auxiliary plug—ie where there is no corresponding axial spacing at that location. Alternatively other means may be provided for signalling past an auxiliary plug—such as those defined above for signalling past the plug located at the region of the axial spacing.

At least one auxiliary plug may be at a location below the plug located at the region of the axial spacing.

The sensing tool may be located below said auxiliary plug.

The installation may comprise a plurality of sensing tools disposed at respective different locations. A first of the sensing tools may be located below said auxiliary plug. A second of the sensing tools may be located above said auxiliary plug but below the plug located at the region of the axial spacing.

At least one auxiliary plug may be at a location above the plug located at the region of the axial spacing.

In one embodiment the well installation comprises the plug located at the region of the axial spacing, a first auxiliary sealing material plug located above the plug located at the region of the axial spacing, a second auxiliary sealing material plug located below the plug located at the region of the axial spacing and a further component plug located below the second auxiliary sealing material plug, wherein a first sensing tool is provided below the further component plug;

a second sensing tool is provided between the further component plug and the second auxiliary sealing material plug;

a first repeater communication unit is disposed between the second auxiliary sealing material plug and the plug located at the region of the axial spacing;

a second repeater communication unit is disposed between the first auxiliary sealing material plug and the plug located at the region of the axial spacing at a location towards the plug located at the region of the axial spacing; and a third repeater communication unit is disposed between the first auxiliary sealing material plug and the plug located at the region of the axial spacing at a location towards the first auxiliary sealing material plug.

This can facilitate measuring of parameters at two locations and transmission of signals across the plugs.

According to another aspect of the present invention there is provided a method of creating a monitoring well installation in a cased borehole comprising the steps of:

creating axial spacing between adjacent casing portions at an intended location for a sealing material plug which is to be provided downhole in the borehole for blocking the interior of the casing and sealing the borehole against the egress of fluid from a zone below the plug, the axial spacing of the casing portions being such that there is an uncased length of borehole in which the material of the plug may seal against the formation in which the borehole is drilled;

installing a sensing tool below the intended location of the plug for sensing at least one parameter below the plug;

providing a communication arrangement for use in transmitting data from the sensing tool towards the surface; and creating the sealing material plug at the downhole location, wherein the communication arrangement comprises across plug communication apparatus located below the plug for transmitting signals carrying data across the plug towards the surface and the across plug communication apparatus comprises a pair of spaced contacts, and the method comprises:

contacting a first of the contacts with the casing below the plug at first location;

contacting a second of the contacts with the casing at a second location further into the borehole than the first location or with the formation at a second location further into the borehole than the first location; and applying signals via the spaced contacts to generate a voltage dipole in the casing to cause electric field in the formation in the region of the plug such as to result in current flow in the casing portion above the axial spacing, the axial spacing being at least 10 m in length.

Note that whilst in practical terms the sensing tool will be installed before the plug, some or all of the communication arrangement may be installed after the installation of the plug.

The axial spacing may be created by one of a number of different means. For example the casing may be cut and upper sections pulled upwards to create the spacing, the material of the casing may be machined, for example milled out to create the spacing, the spacing may be created chemically, for example using thermite.

The method may comprise selecting the frequency of signals which the transmitter or transceiver is arranged to apply in dependence on the length of the axial spacing.

The method may comprise selecting the spacing between the second location and the lower end of the axial spacing in dependence on the length of the axial spacing.

The method may comprise selecting the spacing between the fourth location and the upper end of the axial spacing in dependence on the expected profile of the current induced in the casing portion above the axial spacing.

The method may comprise selecting the spacing between the fourth location and the upper end of the axial spacing in dependence on the length of the axial spacing.

The method may comprise selecting the spacing between the fourth location and the upper end of the axial spacing in dependence on the length of the axial spacing and in dependence on the expected profile of the current induced in the casing portion above the axial spacing. A compromise position may be selected.

Note that in general each of the optional features following each of the aspects of the invention above is equally applicable, where context allows, as an optional feature in respect of each of the other aspects of the invention and could be re-written after each aspect with any necessary changes in wording. Not all such optional features are re-written after each aspect merely in the interests of brevity.

Figure 2:
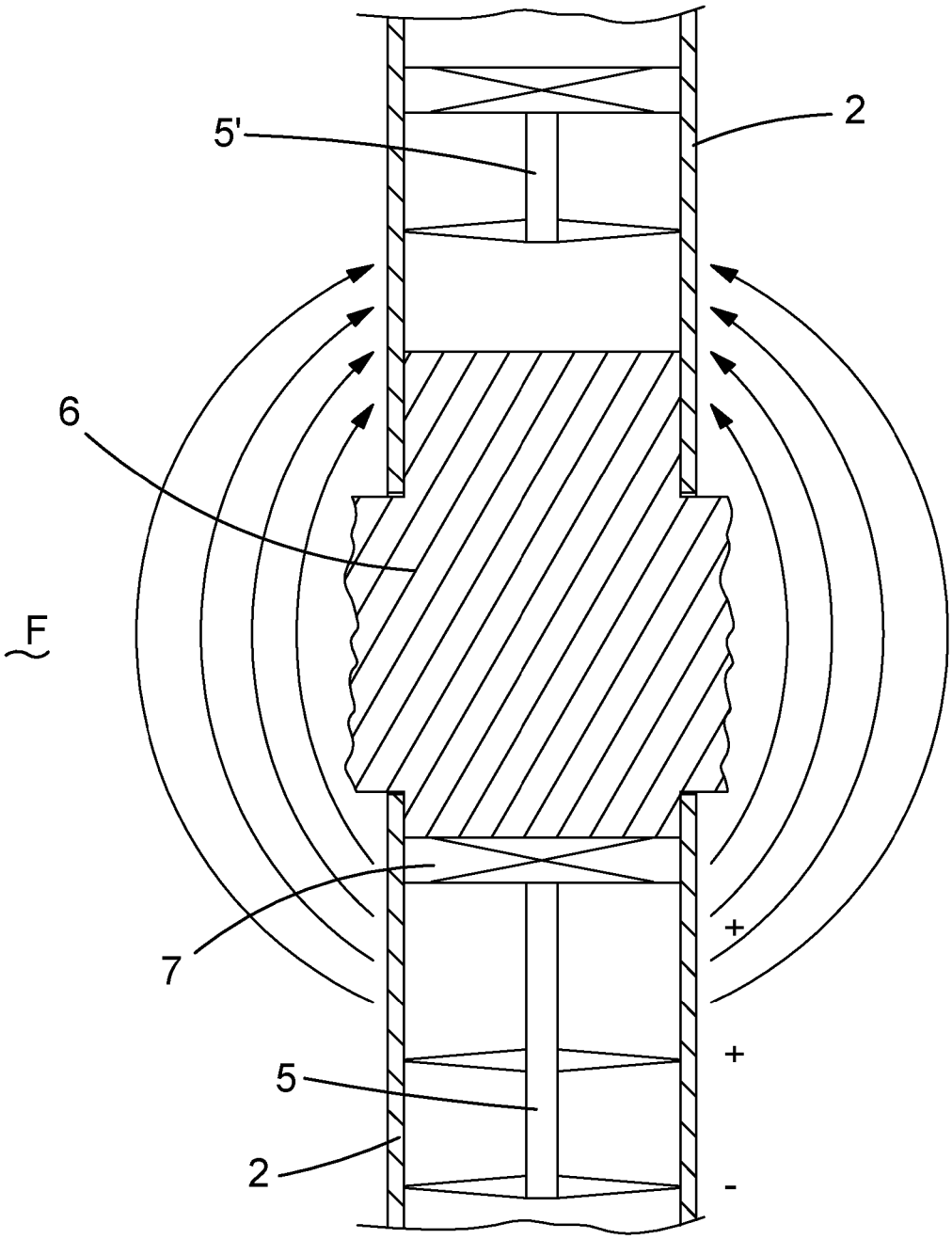
Figure 3:
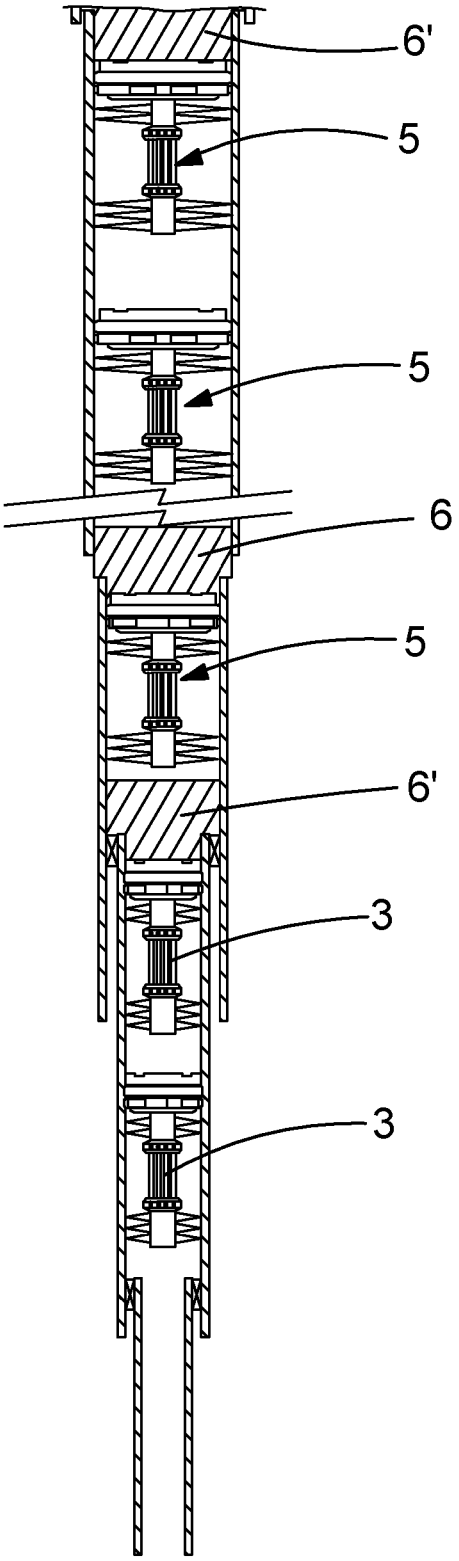
Figure 4:
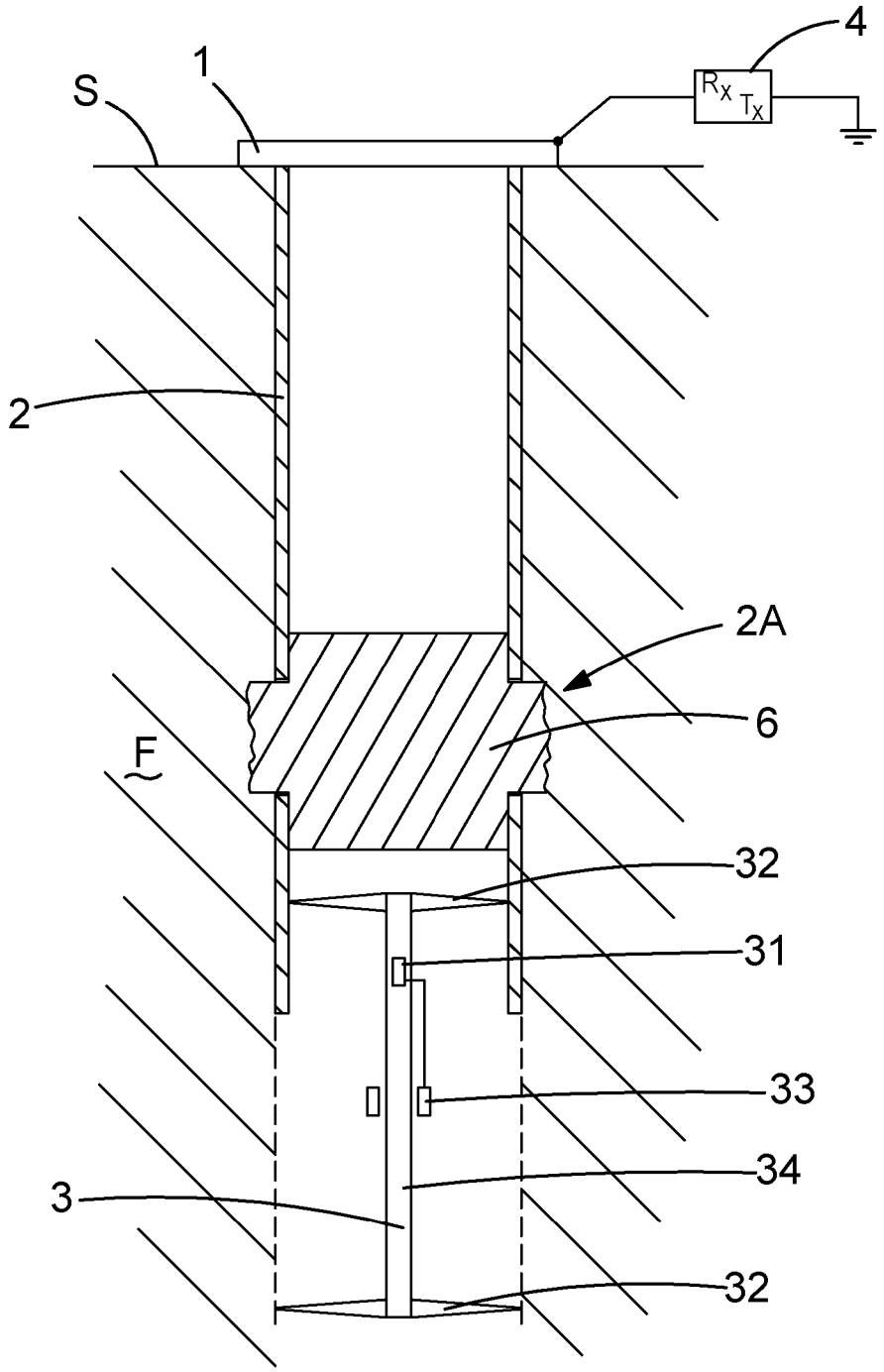

Embodiments of the present invention will now be described, by way of example only, with reference to the accompanying drawings in which:

FIG. 1 schematically shows a monitoring well installation;

FIG. 2 schematically shows part of a well installation of the type shown in FIG. 1 in more detail including a first communication arrangement;

FIG. 3 shows a similar portion of a monitoring well installation including a second communication arrangement; and FIG. 4 shows an alternative well installation.

FIG. 1 schematically shows a monitoring well installation comprising a wellhead 1 and casing 2 descending into a borehole in the formation F. A downhole sensing tool 3 is located downhole in the well for sensing a parameter in its region. Thus for example the sensing tool 3 may be arranged for sensing pressure and/or temperature.

In other alternatives the sensing tool 3 may be arranged for sensing a different parameter which happens to be of interest in a given circumstance. Thus besides temperature and/or pressure a sensor might be arranged to, for example, measure acceleration, vibration, torque, movement, motion, cement integrity, direction and inclination, load, casing angle, corrosion and erosion, radiation, noise, magnetism, seismic movements, stresses and strains on casing including twisting, shearing, compression, expansion, buckling and any form of deformation, chemical or radioactive tracer detection, fluid identification such as hydrate, wax or sand production and fluid properties such as (but not limited to) flow, density, water cut, pH and viscosity. Similarly the sensors may be of different types and may be imaging, mapping and/or scanning devices such as, but not limited to, camera, video, infrared, magnetic resonance, acoustic, ultrasound, electrical, optical, impedance and capacitance.

The exact nature of the parameter to be monitored is not of particular pertinence to the present invention. What is of interest is the ability to provide a monitoring well which allows the extraction of data from a downhole location whilst minimising the risk of escape of fluid via the monitoring well.

The monitoring well comprises a communication arrangement which in turn comprises a below plug communication unit 31, located in this embodiment in the sensing tool 3, an upper communication unit 4 provided, in this case, at the surface S and a below plug repeater communication unit 5.

In this embodiment the sensing tool 3 and the below plug repeater communication unit 5 are both located in the well at a location below a cement plug 6 which is provided in the borehole for blocking the interior of the casing and sealing the borehole against the egress of fluid from a zone below the plug 6.

An axial spacing 2A is provided in the run of casing 2 in the region of the plug 6. That is to say, there is an uncased section of the borehole in the region of the cement plug 6 which in turn means that the cement of the plug bonds directly with the formation F in which the borehole is drilled.

This can lead to an improved sealing of the borehole compared with the situation where the cement plug 6 is formed entirely within the casing 2 as would be conventional. That is to say, a better seal against the egress of fluid can be provided with the present arrangement compared with a situation where the plug is provided wholly within the casing. This is because when cement is provided within casing then inevitably during formation of the plug there is a tendency for the cement to shrink. This in turn risks causing one or more gaps at the interface between the cement and the casing which may allow the escape of fluids either immediately upon installation of the plug or after some time as the seal degrades. In some conventional installations elastomers are provided at the interface between the plug and the casing to try to guard against such leaks. Elastomers cannot however be relied upon in the long term as their elastic properties degrade due to temperature and chemical effects.

It has been determined that a better seal can be obtained if a gap 2A is provided between two casing sections 2 and the cement plug 6 is allowed to seal against, and also optionally, bond directly with, the formation in the region of this axial spacing. Note that the axial spacing 2A is such that there is an entirely uncased region between the two casing sections above and below the level of the plug 6. That is to say there is contact between the cement plug and the formation F surrounding it around the whole of the circumference of the plug 6 at this region. If there was more than one run of casing at this location, an axial spacing would be provided in each run.

Note that the casing 2 portion below the axial spacing 2A, the casing 2 portion above the axial spacing 2A and the uncased section of borehole are all in the same (or a common) borehole. Thus this is distinct from a situation where there may be a gap between casing portions one of which is provided in a main bore and one of which is provided in a lateral. In the present case the borehole is a main bore of the well, but in other cases the borehole could be a lateral borehole, with the casing portions 2 and axial spacing 2A in the lateral as a common borehole.

The axial spacing 2A may be created in various ways. The casing 2 may be cut and pulled to create the spacing, a portion of casing 2 may be machined out, or a portion of the casing 2 may be removed by chemical means.

In the present embodiment parameters are measured by the downhole sensing tool 3. The acquired data is encoded and applied by the below plug communication unit 31 as wireless time varying EM signals to the casing 2 below the plug 6. These signals are then picked up by the below plug repeater communication unit 5 at a location close to but below the plug 6. Signals are reapplied to the casing 2 by the below plug repeater communicator unit 5 such that they may be transmitted past the plug 6 again as EM signals through the material of the formation F and the plug 6. The signals are then picked up by the casing 2 above the level of the plug 6 and travel onwards towards the surface for detection by the upper communication unit 4.

The below plug communications unit 31 comprises a transmitter or transceiver and is arranged for applying signals onto the casing 2 by use of a spaced pair of conductive centralisers 32, one of which is provided at each end of the downhole sensing tool 3. As is now well established in downhole EM communication techniques, signals may be applied onto casing for transmission along the casing 2 as a transmission channel by use of such an arrangement where in effect the downhole sensing tool 3 generates a voltage dipole in the casing and signals progress away therefrom along the casing 2 or other metallic structure present. Similarly such an arrangement may be used for picking up signals.

The below plug communications unit 31 may use other mechanisms for applying and picking up EM signals, for example inductive couplings may be used.

Whilst this type of dipole communication is known for communicating where there is continuous casing (or other metallic structure), different considerations apply when there is a break in the metallic structure in a common borehole. This situation is also different from where there is a gap in casing where a lateral joins a main bore as mentioned above. Whilst not at all clear that this would be the case, the applicants have determined that a similar technique can be used to achieve communication across a plug provided at a gap in the casing in a common bore as described above.

Thus the below plug repeater communication unit 5 comprises a transceiver and conductive centralisers 51 providing spaced contact into the casing 2 to pick up signals and to apply them by producing a voltage dipole. The upper portion of this dipole will generally be of higher impedance than below the below plug repeater communication unit 5 and therefore will achieve a higher proportion of the voltage created by the dipole arrangement.

In this embodiment the below plug repeater communication unit 5 functions as across plug communication apparatus. The below plug repeater communication unit 5 generates a voltage dipole in the casing portion 2 below the axial spacing 2A which in turn creates electric field in the formation F. In turn this induces current in the casing portion 2 above the axial spacing 2A. The induced electric current can be detected by suitable equipment above the axial spacing 2A in the casing 2—in this case at the upper communication unit 4.

Whilst an arrangement such as that shown in FIG. 1 may work satisfactorily in some circumstances in practical terms there will be limits on the data rates which are achievable with the arrangement shown in FIG. 1 and/or limits on the distance over which such a signalling technique will work. Thus, there may be limits on the depth of the well in which such a technique may be used or limits on the depth of the cement plug which may be bridged using such a technique or limits on the depth at which the plug 6 may be located in the well when using the arrangement of FIG. 1.

That said, in some circumstances an even simpler system may be used where the below plug repeater communication unit 5 is dispensed with. In such a case the below plug communication unit 5, which is at or communicatively connected (by eg wired or short hop wireless communication) to the sensing tool 3 may act as across plug communication apparatus providing the function given by the repeater in the above embodiment. This might be most practical if the downhole sensing tool 3 is located close to the underside of the plug 6.

Whilst the system shown in FIG. 1 and described in reference thereto relates to one where EM signalling is used, different signalling techniques may be used and more than one different signalling technique may be used over different legs of the whole communication channel between the downhole sensing tool 3 and the upper communication unit 4.

Below are examples of other communication arrangements which may be used in monitoring the well installations of the present type.

FIG. 2 shows part of a well installation which is similar to that shown in FIG. 1 but with a different arrangement in the region of the cement plug 6. The remainder of the well installation of FIG. 2 is the same as the remainder of well installation that is shown in FIG. 1 and description of it is omitted.

In the embodiment shown in FIG. 2 a second repeater unit 5' is provided adjacent to but above the cement plug 6.

Again in this embodiment signalling across the plug 6 is achieved using EM techniques with the signals progressing through the material of the formation F and the cement plug 6 itself. It can be expected that a stronger signal may be picked up from the casing 2 in the region of the second repeater unit 5' than would be picked up directly at the upper unit 4 in the arrangement shown in FIG. 1. The second repeater unit 5' may then reapply signals for onward transmission to the surface.

In another alternative the upper repeater unit 5' may, say, apply acoustic signals to the casing 2 above the plug 6 and the upper unit 4 may be arranged for picking up acoustic signals.

Further in the embodiment shown in FIG. 2 the below plug repeater communication unit 5 is suspended from a hanger 7 provided at a lower end of the cement plug 6. Note that the hanger 7 will also typically be used in part of the process for forming the plug 6 in the borehole.

The above description has concentrated on the arrangement around the cement plug 6 provided in the location where there is a gap 2A in the run of casing 2. In an actual implementation such a cement plug 6 may not be the only cement plug provided in the installation.

Such a particular installation is shown in FIG. 3.

Here as well as the main cement plug 6 provided at the location where there is an axial spacing in the casing 2A, further auxiliary cement plugs are provided. One auxiliary cement plug 6' is provided above the main cement plug 6 and one auxiliary cement plug 6' is provided below the main cement plug 6.

In the arrangement shown in FIG. 3 there are two downhole sensing tools 3 each for sensing at least one parameter at respective locations in the well. In other examples there may be further sensing tools provided at different locations within the well. In the present embodiment, both downhole sensing tools 3 are provided below the lower auxiliary cement plug 6'.

The arrangement of FIG. 3 also comprises three repeater communication units 5 as well as the downhole sensing tools 3 also being arranged as repeater units.

One of the repeater communication units 5—a below plug repeater communication unit 5 acting as across plug communication apparatus—is located between the lower auxiliary plug 6' and the main plug 6 whereas the other repeater units 5 are located above the main plug 6 but below the upper auxiliary plug 6'.

It will be noted that any number of repeaters 5 and sensing tools 3 may be provided in a particular well installation for particular purposes.

Further any one or more of the devices may be arranged to act as a sealing device (or component plug) for sealing the borehole at its location. Thus for example the lowermost sensing tool 3 may act as a component plug.

In the present embodiment the sensing tools 3 and repeater units 5 are all arranged for effecting EM communication between one another for extracting data from the two sensing tools 3 and passing this towards the surface. On the other hand the uppermost repeater communication unit 5 is arranged for transmitting acoustic signals above its location and for receiving acoustic signals from above its location. Thus whilst the lower part of the communication channel as shown in FIG. 3 relies on EM communication, at locations above this, acoustic communication is used. As such the upper repeater communication unit 5 might be termed an EM-acoustic bridge.

As will be appreciated, different communication techniques may be used for signalling along the whole signal channel in an installation of the type shown in FIG. 3. Thus acoustic, EM, cable, optical, or any other appropriate signalling techniques may be used in any or all legs of the signal channel.

This applies to signalling in both directions. Whilst the above description has been written primarily in terms of signalling from downhole towards the surface such that data may be extracted then, it should be noted that in any of the embodiments above, signalling may be operated in the opposite direction and, for example, control signals may be provided from the surface downwards to any of the components described.

The communication arrangement may be arranged to use one or more of a plurality of signalling techniques in either or both directions, for example, one or more of:

EM signals;
Acoustic signals;
Inductive signals;
Radio frequency signals;
Impedance modulations signals;
Optical signals;
Pressure pulse signals;
Hydraulic control line signals; and
Cable carried electrical signals.

The axial spacing 2A provided in the casing may have a range of different lengths in different implementations. In some cases the axial spacing may be in the order of 10 m. In other cases the axial spacing may be up to say 100 m or even many 100's m.

In terms of effectiveness of signalling across the plug 6, there will be an optimal spacing between the device functioning as across plug communication apparatus and the axial spacing (or gap) 2A—be that the below plug repeater communication unit 5 or the below plug communication unit 31. This optimal spacing will be dependent on the length of the gap 2A. In general terms the optimal spacing will be proportionate to the length of the gap 2A. Thus installing a system may include a step of determining the spacing between the below plug repeater communication unit 5 or the below plug communication unit 31 and the gap 2A in dependence on the length of the gap 2A.

Similarly in terms of effectiveness of signalling downwards across the plug 6 where a repeater communication unit 5' is provided above the plug 6, there will be an optimal spacing between the unit 5' and the gap in the casing 2A. Again this will be proportionate to the length of the gap 2A and an installation method may include determining the spacing between the upper repeater communication unit 5' and the gap 2A in dependence on the length of the gap 2A.

Modelling or analytical methods may be used in such determinations. As the device 31, 5, 5' to gap 2A spacing is increased you gain in terms of the length of casing available for coupling signals to the formation F but you lose in terms of moving the point of signal application further from the gap 2A.

The optimal device to gap spacing may be say 100 m with a 50-100 m gap 2A in the casing 2, whereas with a shorter gap 2A as smaller device to gap spacing may be better.

When considering the pick up of signals by the upper repeater communication unit 5' there will also be an optimal spacing between the repeater communication unit 5' and the gap 2A. This is dependent on the profile of the current induced in the casing above the gap 2A. The induced current will be close to zero immediately next to the gap 2A, reach a maximum after a distance and then tail off.

The location for the upper repeater communication unit 5' may be selected in dependence on a determined optimal location for transmission downwards across the plug and on a determined expected profile for the induced current. The device arranged to act as across plug communication apparatus may be arranged for applying signals via the spaced contacts having a frequency in the range of 0.1 Hz to 1 kHz.

There will be an optimum frequency for the signals in terms of signalling effectiveness across the plug which depends on the length of the axial spacing. The frequency of signals which the device arranged to act as across plug communication apparatus is arranged to apply may be selected in dependence on the length of the axial spacing. Typically a larger axial spacing calls for a lower frequency. Where the axial spacing 2A is in the order of 10 m, the frequency used may be, say, in the range 100 Hz-1 kHz, where the axial spacing in the order of 50-100 m, the frequency used may be, say, in the range 0.1 Hz-10 Hz.

There will be an optimum frequency for the signals in terms of signalling effectiveness across the plug which depends on the conductivity of the formation in the region of the plug. The frequency of signals which the device arranged to act as across plug communication apparatus is arranged to apply may be selected in dependence on the conductivity of the formation in the region of the plug.

In general terms at least one of:

i) the frequency of the signals;
ii) the spacings between the devices 31, 5, 5' on either or both sides of the gap 2A and the gap 2A; and
iii) the spacings between the spaced contacts 32, 52 of the devices 31, 5, 5' on either or both sides of the gap 2A and the gap 2A may be selected in order to provide predetermined desired performance characteristics. This selection may take into account, amongst other things, the length of the axial spacing 2A and the conductivity of the formation F in the region of the plug 6.

FIG. 4 shows a monitoring well installation which is similar to that shown in FIG. 1. Components in common with FIG. 1 are given the same reference numerals and detailed description of those is omitted.

In this case the below plug repeater communication unit of FIG. 1 is omitted. Rather the downhole sensing tool 3 is located in the region of the plug 6. Further the tool 3 extends beyond the casing 2 into open hole. This most typically will be an appropriate arrangement where the plug 6 is relatively deep in the well.

This arrangement is proposed partly on the basis that for the arrangement of FIG. 1 or 2 to function satisfactorily, a sufficient length of casing 2 is needed below the location of the downhole sensing tool 3—say 100 m. If the casing 2 is not available to this depth then the provision of a tool as shown in FIG. 4 which can extend a desired distance into open hole can provide a solution.

In this case whilst the upper conductive centraliser 32 contacts with the casing 2, the lower conductive centraliser 32 contacts with the formation F in open hole. Further the below plug communication unit 31 is arranged to apply (and pick up) signals via a toroid (inductive coupling) 33 provided around a conductive housing 34 of the downhole sensing tool 3. Typically the housing 34 may comprise downhole pipe, such as would be used as production tubing.

In an alternative a simple spaced contact approach might be used, but this would be less effective. In another alternative the below plug communication unit can be arranged to apply (and pick up) signals across an insulation joint (eg a gap sub) provided in the housing of the downhole sensing tool 3.

It will be appreciated that in principle there is no reason why the arrangement of the downhole sensing tool 3 in FIG. 4 should not also be used as a repeater, if there is need to pick up signal from some other more remote (say deeper) location.

The invention claimed is:

1. A monitoring well installation comprising metallic casing running down from the surface into a borehole and a sealing material plug provided downhole in the borehole for blocking the interior of the casing and sealing the borehole against the egress of fluid from a zone below the plug, wherein there is an axial spacing between adjacent casing portions in the region of the plug such that there is an uncased length of borehole in which the material of the plug seals against the formation in which the borehole is drilled, and wherein there is provided a downhole sensing tool located below the plug for sensing at least one parameter below the plug and a communication arrangement for use in transmitting data from the sensing tool towards the surface, wherein the communication arrangement comprises across plug communication apparatus located below the plug for transmitting signals carrying data across the plug towards the surface and the across plug communication apparatus comprises a pair of spaced contacts, a first of which contacts with the casing below the plug at first location and the second of which contacts with the casing at a second location further into the borehole than the first location or contacts with the formation at a second location further into the borehole than the first location and a transmitter or transceiver for applying signals via the spaced contacts to generate a voltage dipole in the casing to cause electric field in the formation in the region of the plug such as to result in current flow, in use, in the casing portion above the axial spacing, the axial spacing being at least 10 m in length.

2. A monitoring well installation according to claim 1 in which the communication arrangement comprises a below plug communication unit provided in or communicatively connected to the sensing tool for transmitting signals carrying data towards the surface and the across plug communication apparatus comprises the below plug communication unit.

3. A monitoring well installation according to claim 1 in which the communication arrangement comprises a below plug communication unit provided in or communicatively connected to the sensing tool for transmitting signals carrying data towards the surface and a below plug repeater communication unit for receiving signals from the below plug communication unit and transmitting signals onwards towards the surface, wherein the across plug communication apparatus comprises the below plug repeater communication unit.

4. A monitoring well installation according to claim 1 in which the frequency of signals which the transmitter or transceiver is arranged to apply is selected in dependence on at least one of:

i) the length of the axial spacing; and ii) the conductivity of the formation in the region of the plug.

5. A monitoring well installation according to claim 1 in which the spacing between the second location and the lower end of the axial spacing is selected in dependence on the length of the axial spacing.

6. A monitoring well installation according to claim 1 in which the communication arrangement comprises at least one auxiliary repeater communication unit in the communication channel from the downhole sensing tool towards the surface for assisting in communication of data towards the surface.

7. A monitoring well installation according to claim 6 in which the at least one auxiliary repeater communication unit comprises an above plug repeater communication unit located above the plug for picking up signals from the casing portion above the axial spacing due to said current flow.

8. A monitoring well installation according to claim 7 in which the above plug repeater communication unit comprises a pair of spaced contacts for picking up the signals from the casing, a first of which contacts with the casing above the plug at third location and the second of which contacts with the casing at fourth location further towards the surface than the third location.

9. A monitoring well installation according to claim 8 in which the spacing between the fourth location and the upper end of the axial spacing is selected in dependence on the expected profile of the current induced in the casing portion above the axial spacing.

10. A monitoring well installation according to claim 8 in which the spacing between the fourth location and the upper end of the axial spacing is selected in dependence on the length of the axial spacing.

11. A monitoring well installation according to claim 1 in which the across plug communication apparatus has a first contact which contacts with the casing and a second contact which contacts with the formation at an open hole location.

12. A monitoring well installation according to claim 11 in which the across plug communication apparatus is arranged to apply signals via an elongate metallic member that extends from a cased region to an open hole region.

13. A method of creating a monitoring well installation in a cased borehole comprising the steps of:

creating axial spacing between adjacent casing portions at an intended location for a sealing material plug which is to be provided downhole in the borehole for blocking the interior of the casing and sealing the borehole against the egress of fluid from a zone below the plug, the axial spacing of the casing portions being such that there is an uncased length of borehole in which the material of the plug may seal against the formation in which the borehole is drilled;

installing a sensing tool below the intended location of the plug for sensing at least one parameter below the plug;

providing a communication arrangement for use in transmitting data from the sensing tool towards the surface; and creating the sealing material plug at the downhole location, wherein the communication arrangement comprises across plug communication apparatus located below the plug for transmitting signals carrying data across the plug towards the surface and the across plug communication apparatus comprises a pair of spaced contacts, and the method comprises:

contacting a first of the contacts with the casing below the plug at first location;

contacting a second of the contacts with the casing at a second location further into the borehole than the first location or with the formation at a second location further into the borehole than the first location; and applying signals via the spaced contacts to generate a voltage dipole in the casing to cause electric field in the formation in the region of the plug such as to result in current flow in the casing portion above the axial spacing, the axial spacing being at least 10 m in length.

14. A method according to claim 13 comprising the step of selecting the frequency of signals which the transmitter or transceiver is arranged to apply in dependence on at least one of:

i) the length of the axial spacing; and ii) the conductivity of the formation in the region of the plug.

15. A method according to claim 13 comprising the step of selecting the spacing between the second location and the lower end of the axial spacing in dependence on the length of the axial spacing.

* * * * *